US007493189B2

(12) United States Patent
Berdelle-Hilge et al.

(10) Patent No.: US 7,493,189 B2
(45) Date of Patent: Feb. 17, 2009

(54) METHOD FOR SORTING MAILINGS ACCORDING TO THE DISTRIBUTION SEQUENCE

(75) Inventors: Peter Berdelle-Hilge, Constance (DE); Nikolaus Haselberger, Radolfzell-Markelfingen (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/571,250

(22) PCT Filed: Sep. 7, 2004

(86) PCT No.: PCT/EP2004/009962

§ 371 (c)(1),
(2), (4) Date: Mar. 9, 2006

(87) PCT Pub. No.: WO2005/025763

PCT Pub. Date: Mar. 24, 2005

(65) Prior Publication Data

US 2007/0027574 A1 Feb. 1, 2007

(30) Foreign Application Priority Data

Sep. 15, 2003 (DE) ..... 103 42 464

(51) Int. Cl.
*G06F 7/00* (2006.01)
*B07C 5/00* (2006.01)
*G06K 9/00* (2006.01)

(52) U.S. Cl. ..... 700/224; 700/213; 209/584

(58) Field of Classification Search ..... 700/223, 700/213, 219, 228, 230, 224; 209/584
See application file for complete search history.

(56) References Cited

U.S. PATENT DOCUMENTS

| | | | | |
|---|---|---|---|---|
| 5,287,271 | A | 2/1994 | Rosenbaum | |
| 6,687,569 | B1 * | 2/2004 | Skinger et al. | 700/220 |
| 6,687,570 | B1 * | 2/2004 | Sussmeier et al. | 700/220 |
| 6,711,462 | B2 * | 3/2004 | Flores et al. | 700/223 |
| 2004/0153208 | A1 * | 8/2004 | Wilke | 700/224 |
| 2004/0186616 | A1 * | 9/2004 | Overman et al. | 700/224 |
| 2006/0113223 | A1 * | 6/2006 | Quine et al. | 209/584 |

FOREIGN PATENT DOCUMENTS

| | | |
|---|---|---|
| DE | 199 43 362 | 3/2001 |
| EP | 0 140 760 | 5/1985 |
| EP | 0 684 086 | 11/1995 |
| EP | 0 820 818 | 1/1998 |
| EP | 0 999 902 | 5/2000 |
| EP | 1 258 297 | 11/2002 |
| WO | WO 99/07487 | 2/1999 |

* cited by examiner

*Primary Examiner*—Gene O. Crawford
*Assistant Examiner*—Ramya G Prakasam
(74) *Attorney, Agent, or Firm*—Laurence A. Greenberg; Werner H. Stemer; Ralph E. Locher

(57) ABSTRACT

Method for sorting mailings according to the distribution sequence in a sorter unit with circulating pouches, the number of pouches in a pouch circuit being less than the number of mailings for sorting in said sorting run. After all pouches are loaded, the separation and reading of the remaining mailings for the sorting run is carried out and the mailings are divided into one part for corresponding mailing points for the beginning or end of the sequence, and another part for all the charged mailings, which are then buffered. The mailings in the pouches are then sorted according to the sequence. The buffered mailings are placed in the empty pouches and then separated into further distribution sections, when not all buffered mailings fit in the pouches. Once all pouches are filled with the buffered mailings for the subsequent distribution section the next sorting is carried out.

5 Claims, 8 Drawing Sheets

METHOD FOR SORTING MAILINGS ACCORDING TO THE DISTRIBUTION SEQUENCE

BACKGROUND OF THE INVENTION

The invention relates to a method for sorting mailings according to a distribution sequence.

The task of sending out mailings is made considerably easier if the sequence of the volumes of mailings for the individual mailing points in the mailing containers corresponds to the sequence of mailing points on the mailing path.

A number of devices for the production of such distribution sequences that take special account of large letters are known, some of which rely on single pass methods.

Such a method is characterized by the fact that the whole mailing volume that is to be brought into a distribution sequence is separated only once, as described, for example, in EP 0 820 818 A1 and DE 199 43 362 A1.

Multi-pass methods on the other hand are characterized by multiple separations of the whole mailing volume, as described, for example, in EP 1 258 297 A1.

Another known method involves carrying out a pre-sorting and a final sorting on a sorting machine at the same time if the capacity required for the final sorting is greater than the capacity that is available in the sorting machine for the final sorting. Thus some of the mailings are already finally sorted in the first sorting run. The remaining mailings, that were initially only pre-sorted, are again sent to the sorting machine for final sorting. In this method the pre-sorting follows a pre-sorting plan that has been fixed before pre-sorting, as described, for example, in EP 0 999 902 B1.

Distribution sequence sorting machines comprising a single pass process are known exclusively in the pouch sorter design, wherein the ring of pouches functions as a storage unit having optional access to the storage points thereof. This fundamentally limits the mailing volume as a function of the number of pouches in the sorter, which has to be equal to or greater than the mailing volume. Hitherto no methods for pouch sorters have been disclosed that allow a precise division of the mailing volume to be processed into corresponding partial volumes without prior information about the mailings. These partial volumes are in each case characterized by having a coherent range of mailing points and are smaller than or equal to the capacity of the machine (that is the number of pouches in the ring of pouches).

SUMMARY OF THE INVENTION

The object of the invention is to provide a generic method for sorting the mailings according to the distribution sequence in a sorter having circulating pouches each for one respective mailing, the number of pouches in a ring of pouches being less than the number of mailings for sorting, and in which method the number of reading and division procedures is reduced.

Accordingly, one aspect involves a method for sorting mailings according to a distribution sequence in a sorter having circulating pouches, wherein a number of pouches in a ring of pouches is lower than a number of mailings that are to be sorted. The mailings are separated, their mailing addresses are read, and loaded into the pouches until each pouch is filled with one mailing. Remaining mailings are separated, and their mailing addresses are read. The mailings are divided into a first portion for coherent mailing points at a beginning or at an end of the distribution sequence, and into a second portion for ejected mailings that do not fit into the pouches. The first portion is in the pouches at the end of said dividing, and the mailings of the second portion are buffered. The dividing is achieved by exchanging the mailings in the pouches and ejecting the mailings that have been exchanged or by direct ejection through at least one separation outlet of the sorter. The mailings located in the pouches are sorted according to the distribution sequence. The buffered mailings are fed, and separated and loaded into empty pouches, and divided into distribution sections of the distribution sequence if not all the buffered mailings fit into the pouches. When all the pouches are filled with the buffered mailings for an adjacent distribution section, the buffered mailings are sorted according to the distribution sequence of the adjacent distribution section. At least one of the dividing and sorting process is repeated with the separated mailings until all the mailings are sorted.

In the method according to the invention, the sorter does not first run empty in the first sorting run before the following sorting run can start. As a result of the fact that in the first sorting run, in which all the mailings are read and separated, the mailings remaining in the pouches are first separated and subsequently arranged in sequence, it is now only the separated mailings that still require further processing.

Thus in order to reduce the amount of reading and the number of reading errors, it is advantageous, after the first division, to provide the mailings with machine-readable identification symbols, store the mailing addresses that have been read in a data file according to the identification symbols, and when mailings are input again to read only the identification symbols and identify the mailing addresses with the aid of the data file.

For simple and safe division it is advantageous, in the first sorting according to the coherent mailing points at the beginning of a distribution sequence, to exchange the mailing in the pouches with the highest position in the distribution sequence for the next mailing that has been input and eject it via a separation outlet, if the position of the mailing in this pouch in the distribution sequence is higher than that of the newly input mailing, or in the first sorting according to the coherent mailing points at the end of a distribution sequence, to exchange the mailing in the pouches with the lowest position in the distribution sequence for the next mailing that has been input and eject it via a separation outlet, if the position of the mailing in this pouch in the distribution sequence is lower than that of the newly input mailing. The above procedure is repeated until all the mailings have run through the sorter.

If there is prior knowledge available relating to the mailing addresses of the mailings to be sorted, for example from readings of previously stored processes, then the mailings that are to be separated are advantageously subdivided over a plurality of division processes into sections of the distribution sequence and ejected. As a result of the above pre-sorting of the separated mailings, a considerable reduction in division and separation work can be achieved in the case of larger mailing volumes.

In order to reduce sorting times it is advantageous to carry out the sorting by emptying the pouches and loading empty pouches with separated or new mailings at the same time.

BRIEF DESCRIPTION OF THE SEVERAL VIEWS OF THE DRAWINGS

The novel features and method steps characteristic of the invention are set out in the claims below. The invention itself, however, as well as other inventive features and advantages thereof, are best understood by reference to the detailed description, which follows, when read in conjunction with the accompanying drawings, wherein:

DETAILED DESCRIPTION OF THE INVENTION

Figure 1:
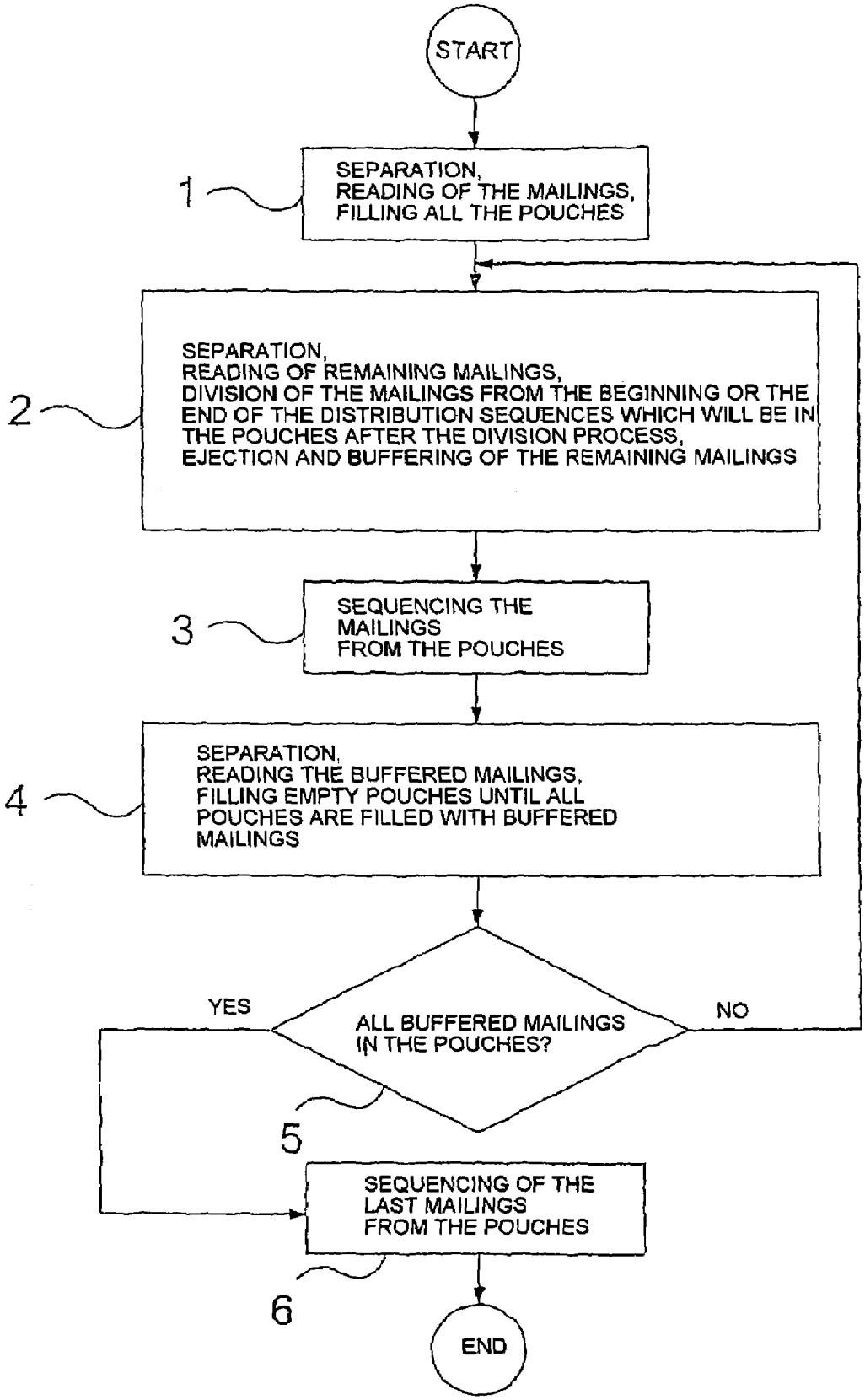
FIG. 1 depicts a flow chart showing the stages of the sorting process.

The method shown in FIG. 1 is as follows:

The first step is: separation, reading of the mailings and filling of all the circulating pouches 1, from which the mailings can be placed into a predetermined order by means of carefully targeted opening of the pouches.

Then follows the separation and reading of the remaining mailings in this sorting run and the division of the mailings from the beginning or end of the distribution sequence which fit into the pouches and are in the pouches at the end of the distribution sequence from the remaining mailings that are ejected and buffered 2. The mailings in the pouches are then sorted in a known manner into the predetermined distribution sequence according to the mailing addresses that have been found for them (sequencing) 3.

Subsequently, or even during the sequencing, as soon as the pouches are empty, there follows the separation and reading of the mailings and filling of the empty pouches until all the pouches have been filled with the buffered mailings 4.

Once all the buffered mailings are in the pouches, they are then sorted according to the distribution sequence 5 and the whole sorting process is complete. If, however, the number of buffered mailings is greater than the number of pouches in the circulating ring of pouches, there then follows the separating and reading of the further mailings and the division of the mailings from an adjacent section in the distribution sequence that are in the pouches at the end of said division process, together with the ejection and buffering of the mailings that now remain 2. Once this process has been completed, the mailings in the pouches in the distribution sequence of this section are sorted 3. Then the currently buffered mailings are separated, read and transported into the empty pouches until all the pouches have been filled 4.

If all the buffered mailings are now in the pouches 5, the sequencing of the last mailings for the respective section then ensues and the sorting run is complete, and if they are not, then another division/sequencing ensues as described above. The process of division is explained with the aid of FIGS. 2*a-g* using a simple example in diagram form. The sorter for said embodiment has a circulating ring of pouches, the pouches of which are emptied onto a subdivided conveyor belt in such a way that the mailings at the end of the subdivided conveyor belt are transported in the distribution sequence into a container or combined.

Figure 2A:
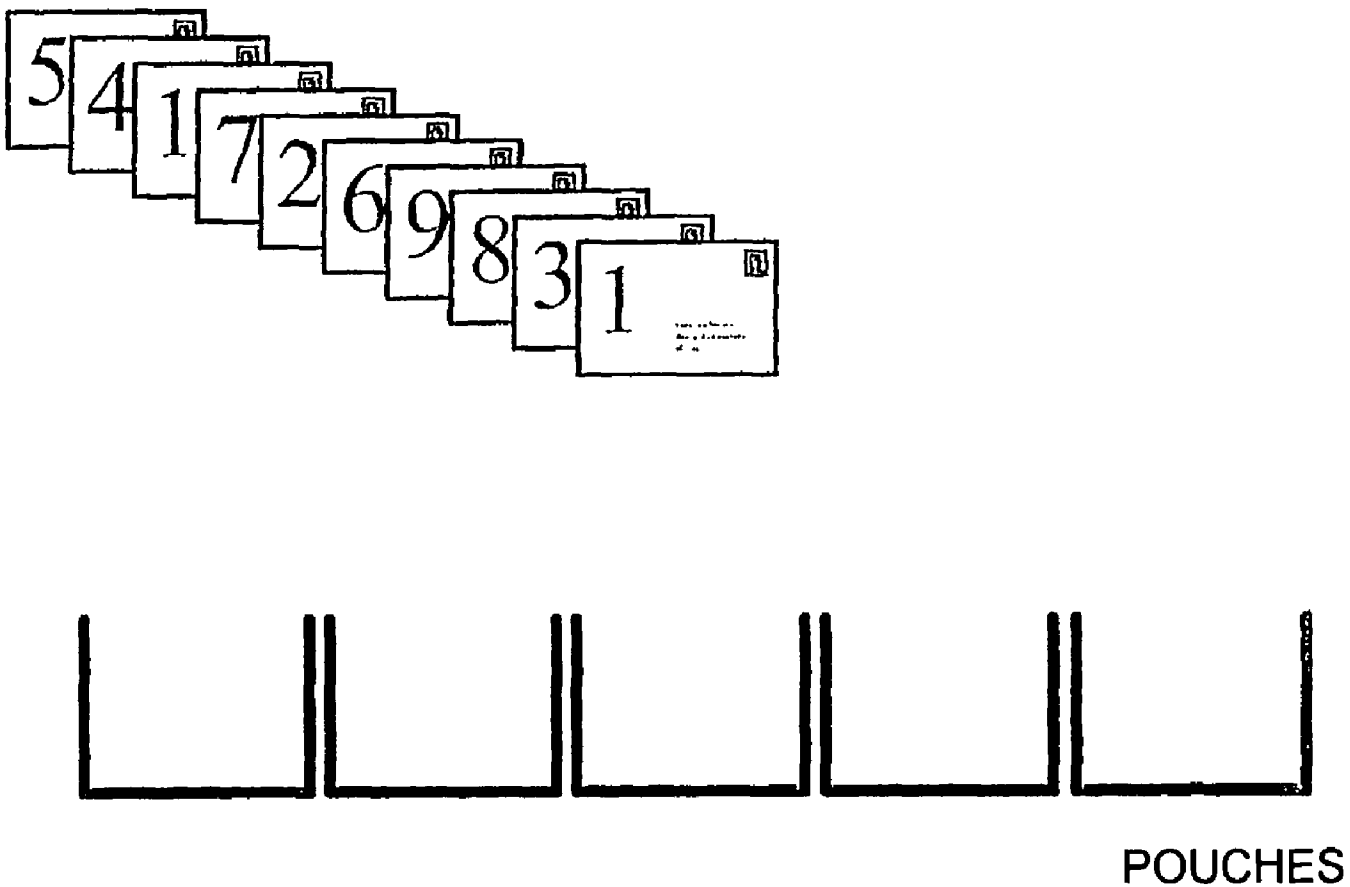
FIGS. 2*a-g* depict a simplified illustration of the division process in diagram form.

The numbers on the ten mailings that are to be sorted show the sequence in the mailing operation, i.e. mailing 1 is mailed first and mailing 10 last. The ring of pouches has 5 pouches, each of which takes one mailing, and which empty their content in a controlled manner onto the sections of the subdivided conveyor belt or separately (FIG. 2*a*).

Figure 2B:
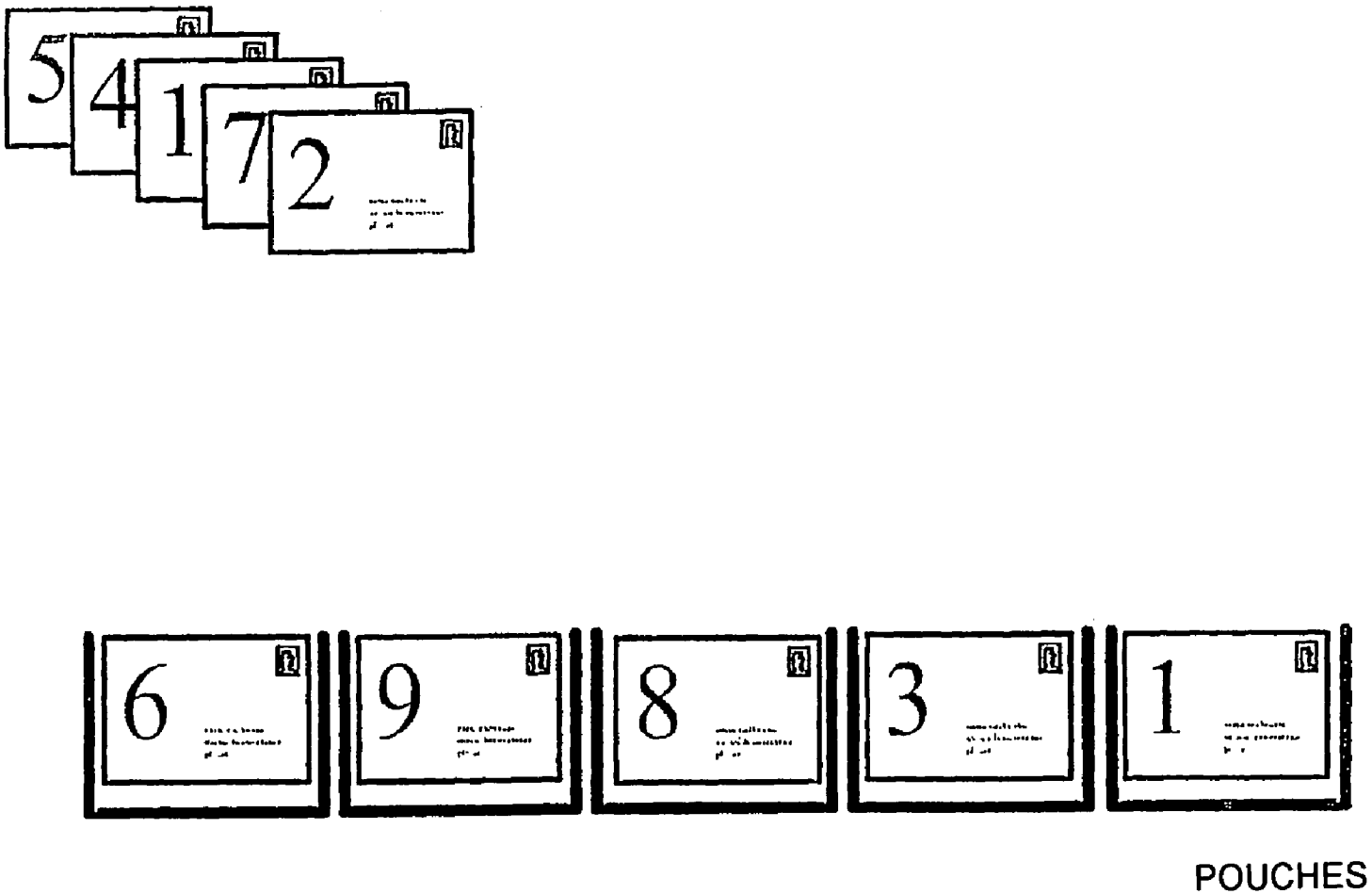

First, the first 5 mailings in the pile, with the numbers 1, 3, 8, 9, 6 are loaded into the 5 pouches (FIG. 2*b*). Since the number of mailings exceeds the number of pouches, and at the start, the mailings to be sequenced are those at the beginning of the distribution sequence, the mailings at the end with the numbers 6 to 10 are first ejected. This is achieved by the remaining five mailings being likewise fed into the sorter, separated and read. Since the first portion of the mailings for the distribution route is to be sequenced first, the mailings in the part at the rear have to be separated. This is achieved by the mailing in the pouches having the highest value in the distribution sequence being exchanged for the mailing which has just been separated that has a lower order of precedence in the distribution sequence and being ejected.

Figure 2C:
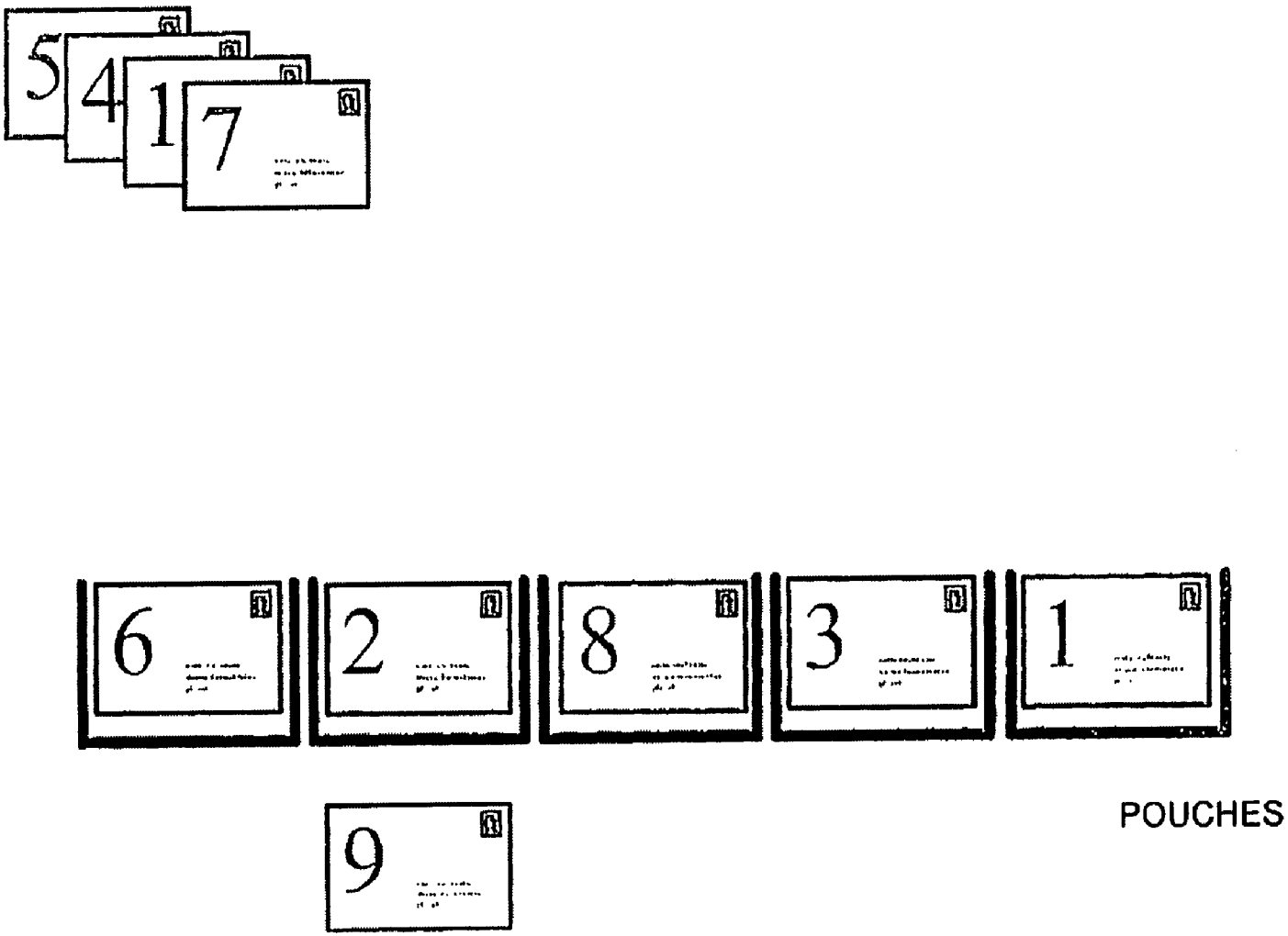
Figure 2D:
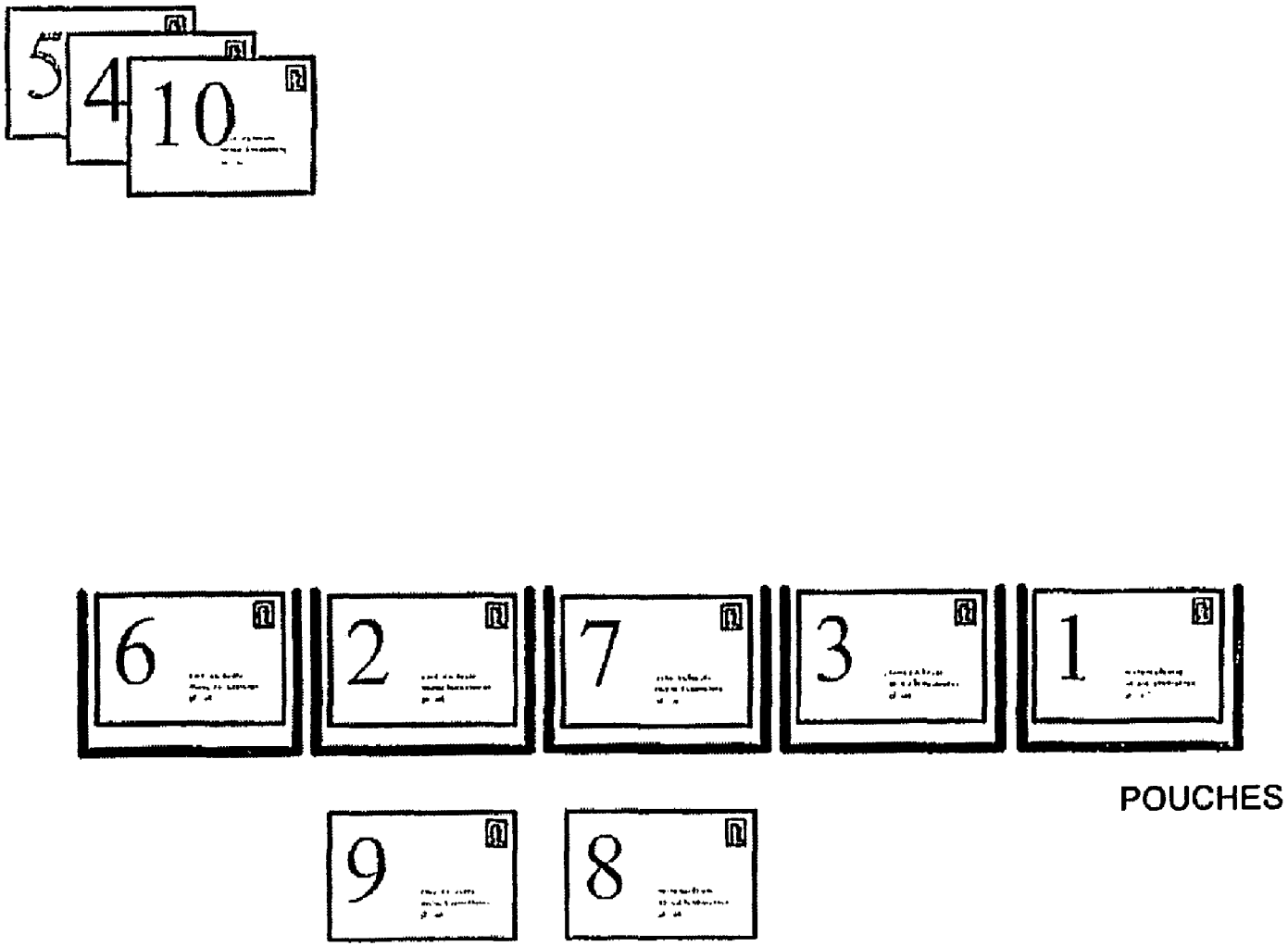

If, on the other hand, the new mailing has an even higher value, it is ejected immediately. This means that first mailing 2 is exchanged in the pouch for mailing 9, by mailing 9 being ejected and mailing 2 being loaded into the pouch that has been vacated (FIG. 2*c*). Then the next mailing 7 is exchanged for mailing 8 (FIG. 2*d*).

Figure 2E:
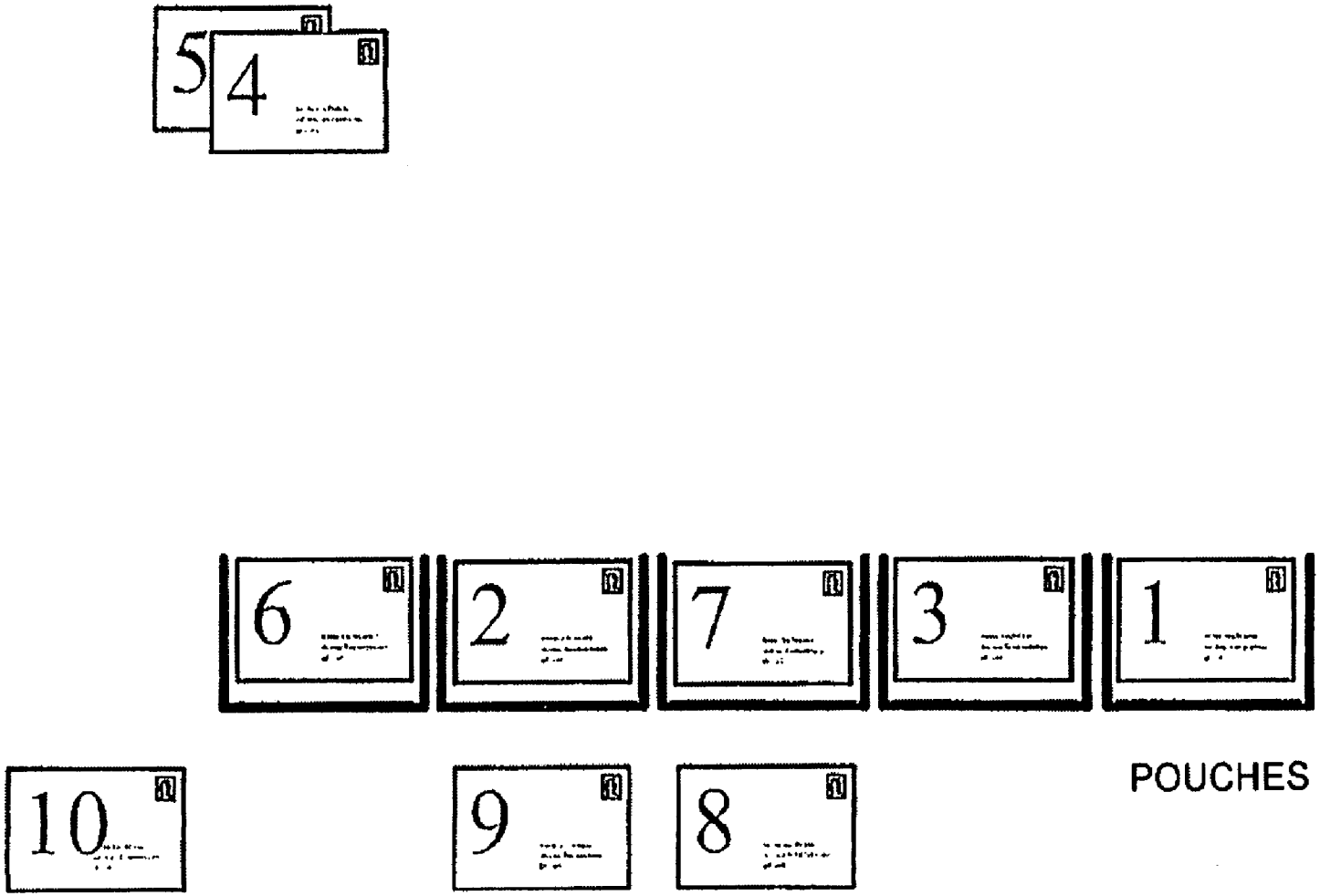
Figure 2F:
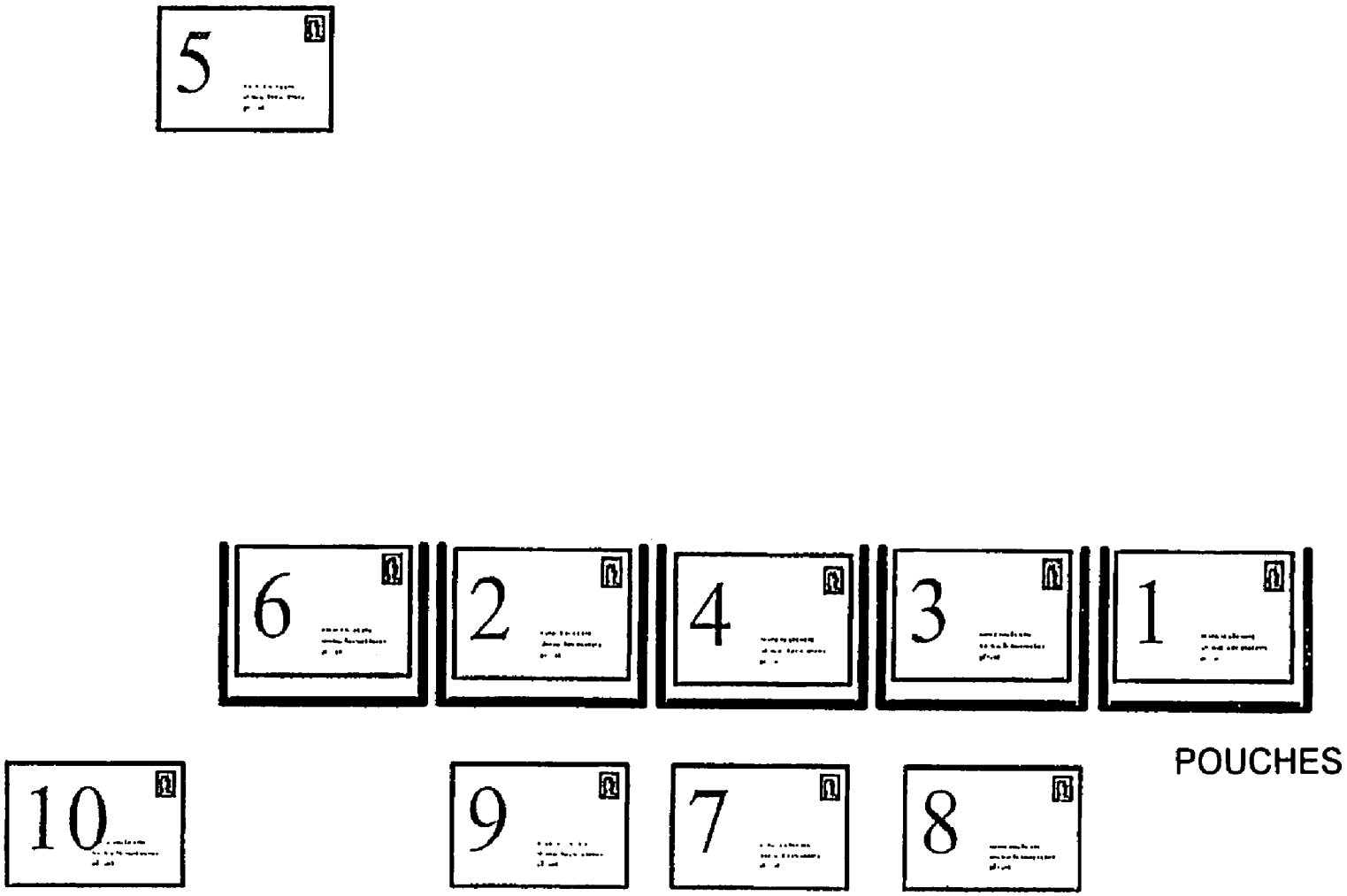
Figure 2G:
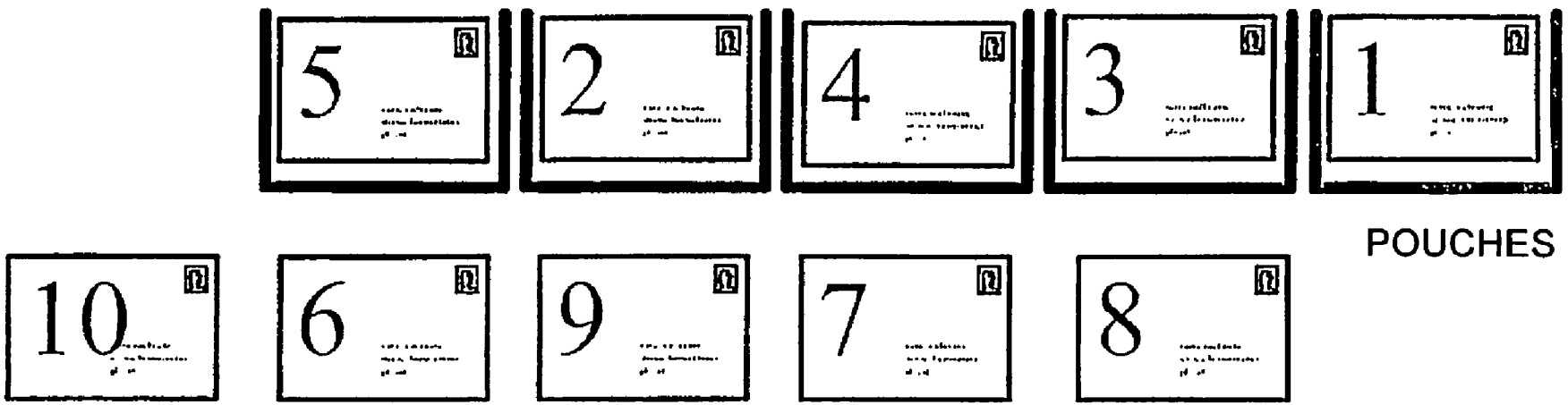

Since the mailing 10 that is subsequently fed in is higher in the order of precedence than all the other mailings that are in the pouches, it is ejected immediately (FIG. 2*e*). Finally, mailing 4 is exchanged for mailing 7 and mailing 5 is exchanged for mailing 6 (FIGS. 2*f* and 2*g*).

The mailings that have been ejected 10, 6, 9, 7, 8 are buffered and mailings 5, 2, 4, 3, 1, which are in the pouches, are emptied onto the conveyor belt in the correct order of precedence and from there stacked into a container. Subsequently the separated and buffered mailings 10, 6, 9, 7, 8 are once again fed into the sorter and immediately sequenced since the number thereof coincides with the number of pouches, and are transported into the container. Therefore, the container now contains the ten mailings in the distribution sequence. If the number of mailings had still been greater than the number of pouches, then a further division process would have had to be carried out.

The invention claimed is:

1. A method for sorting mailings according to a distribution sequence in a sorter having circulating pouches, wherein a predetermined number of pouches is lower than a number of mailings to be sorted, and wherein the distribution sequence includes coherent mailing points in a predetermined order of distribution, wherein the order of distribution begins at a first distribution point and ends at a last distribution point, the method comprising:

in a first phase, separating a mailing from the number of mailings to be sorted;

reading a mailing address of the mailing;

determining a distribution point assigned to the mailing address and determining a position of the distribution point within the order of distribution;

loading the mailing into an empty pouch;

repeating the steps of the first phase until each pouch is filled with one mailing;

in a second phase, if all pouches are filled, separating a subsequent mailing from the number of mailings to be sorted;

reading a mailing address of the subsequent mailing;

determining a distribution point assigned to the mailing address of the subsequent mailing and determining a position of the distribution point within the order of distribution;

if the position of the distribution point assigned to the mailing address of the subsequent mailing is lower than a highest position of a distribution point of a mailing in a pouch, feeding the mailing having the highest position from the pouch to a buffer, and loading the subsequent mailing into the pouch;

if the position of the distribution point assigned to the mailing address of the subsequent mailing is higher than the highest position, feeding the subsequent mailing to the buffer; and repeating the steps of the second phase until the pouches include only mailings having neighboring distribution points.

2. The method of claim 1, further comprising extracting the mailings from the pouches according to the order of distribution.

3. The method of claim 2, wherein the extracted mailings include a mailing assigned to the first distribution point.

4. The method of claim 1, further comprising providing the mailings with machine-readable identification symbols once the mailings are separated for the first time, and storing the mailing addresses in a data file in association with the identification symbols, so that when the mailings are fed in once again only the identification symbols are now read and the mailing addresses are determined via the data file.

5. The method of claim 1, further comprising repeating the first and second phases until all mailings are sorted.

* * * * *